United States Patent [19]

Savvides

[11] 4,173,308

[45] Nov. 6, 1979

[54] SPRINKLERS

[76] Inventor: Loucas Savvides, 59 Ifigenias St., Acropolis 112 Nicosia, Cyprus

[21] Appl. No.: 899,188

[22] Filed: Apr. 24, 1978

[51] Int. Cl.[2] ..... B05B 1/34

[52] U.S. Cl. ..... 239/383; 239/464; 239/468

[58] Field of Search ..... 239/102, 380–383, 239/464, 468, 533.1, 570

[56] References Cited

U.S. PATENT DOCUMENTS

| | | | |
|---|---|---|---|
| 1,515,664 | 11/1924 | Dunkelberger | 239/381 |
| 2,218,110 | 10/1940 | Hosmer et al. | 239/468 X |
| 2,767,024 | 10/1956 | Swan | 239/383 |

FOREIGN PATENT DOCUMENTS

| | | | |
|---|---|---|---|
| 269540 | 11/1929 | Italy | 239/468 |

*Primary Examiner*—Robert B. Reeves
*Assistant Examiner*—Andres Kashnikow
*Attorney, Agent, or Firm*—Ladas, Parry, Von Gehr, Goldsmith & Deschamps

[57] ABSTRACT

A sprinkler comprises a body defining a hollow, generally cylindrical interior, a liquor inlet to the interior, and a liquid outlet from the interior which in use is located above the inlet. A member is located in the interior so as to be rotated when a liquid under pressure enters the inlet.

8 Claims, 9 Drawing Figures

SPRINKLERS

The present invention concerns sprinklers. Such sprinklers are frequently used in agriculture or gardening.

The invention has for an object to provide a sprinkler which is simple, efficient and robust.

Accordingly the invention consists in a sprinkler having a hollow, generally cylindrical interior which is provided with a liquid inlet and a liquid outlet which in use is located above the inlet, a member being located in the interior so as to be rotated when a liquid under pressure enters the inlet.

According to a feature of the invention the height of the cylindrical interior is preferably twice its diameter. Furthermore the diameters of the inlet and the outlet may each be between a quarter and an eighth of the interior diameter.

According to a further feature of the invention the member of the interior consist either of a metallic ball or of a cylindrical body. In the second case the cylindrical body is supported either on a short tube or on a ball.

Figure 1:
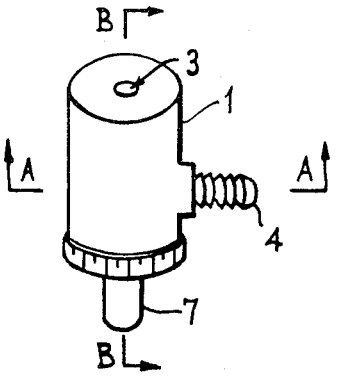
Figure 2:
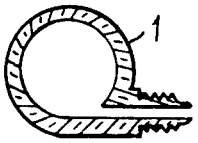
Figure 3:
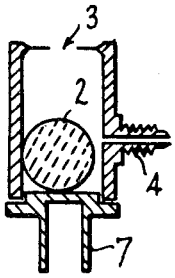
Figure 4:
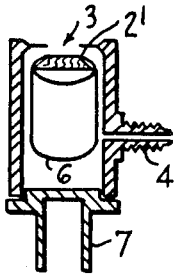
Figure 5:
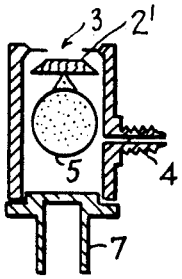
Figure 6:
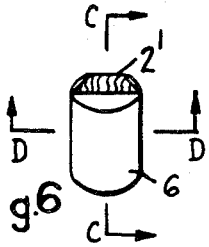
Figure 7:
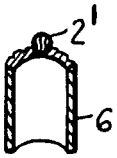
Figure 8:
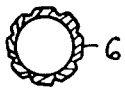
Figure 9:
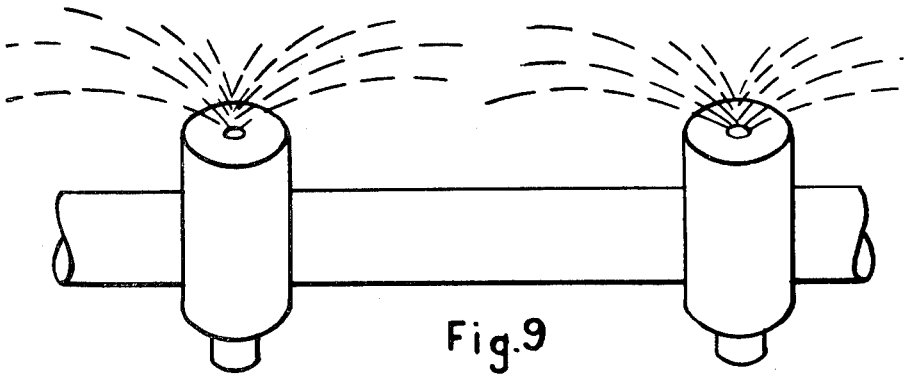

In order that the present invention may be more readily understood, various embodiments thereof will now be described by way of example, and with reference to the accompanying drawings, in which:

FIG. 1 is a perspective view of a sprinkler constructed in accordance with the present invention, FIG. 2 is a section on line A—A of FIG. 1, FIG. 3 is a section on line B—B of FIG. 1, FIG. 4 is a sectional view of a second embodiment, FIG. 5 is a sectional view of a third embodiment, FIG. 6 is a perspective view of the member in the interior of the embodiment of FIG. 4, FIG. 7 is a sectional view along the line C—C of FIG. 6, FIG. 8 is a cross-sectional view of the line D—D of FIG. 6, and FIG. 9 is a perspective view showing two sprinklers attached to a water pipe.

Referring now to FIGS. 1 to 3 of the accompanying drawings, these show a sprinkler consisting of a main body having the shape of a cylindrical chamber. This body has a water inlet 4, a water outlet 3 and a metallic ball 2. The metal ball has a diameter which is at least half and preferably approximately three quarters of the internal diameter of the interior. Furthermore this metal ball 2 is free and revolves as water passes through the chamber.

Both the water inlet 4 and outlet 3 are of smaller diameter than the diameter of the main body. The ratio between the inlet and outlet diameters and the main body diameter may vary between 1:4 to 1:8.

Water enters the water inlet 4 at a tangent to the inside surface walls of the main body so that the incoming water is forced to flow and circulate around the inside walls of the body before leaving the exit 3. The force of the incoming water causes the metallic ball 2 to rise up and revolve in the upper part of the body below the outlet 3 thus forcing the water to spread out uniformly in all directions as it leaves the outlet 3.

The outcoming water is in the form of small drops and not mist as it happens with some sprinklers. Furthermore neither are big drops formed as happens with some other known types of sprinklers.

The ball 2 should be metallic in order to have a requisite mass which after revolving helps to develop centrifugal forces. If the ball is not of sufficient mass there will not be developed centrifugal forces and as water enters the sprinkler body, the ball will rise up and close the exit 3. Furthermore if the ball diameter is smaller than the radius of the body it will revolve but without the favourable effects as mentioned before, i.e. the outcoming water will not be spread uniformly in all directions around the body. Similarly, if the ball diameter is too big, thus approaching the body inside diameter, then the sprinkler will not perform properly because the ball will not revolve to develop the centrifugal forces and will again close the outlet 3.

A suitable ratio of the ball diameter and body's inside diameter was found to be 3:4 or 0.75.

Regarding the height of the body this should very depending upon its diameter. The best ratio between diameter and height has been found to be 1:2.

The water inlet 4 is externally screw threaded so it can be attached to plastics or polyethylene pipes as shown in FIG. 9. However any other type of attachment could be used.

A typical sprinkler of this type studied has the following dimensions and could be economically constructed and used in irrigating orchard plantations on the basis of permanent installation.

Body inside diameter: 16 mm
Height of the body: 30 mm
Entry diameter: 2 mm
Exit diameter: 4 mm
Ball diameter: 14 mm The material used for the body construction is usually P.V.C. however brass or any other material could be used.

Although the ball is described as being metallic it could of course be any material or combination of materials provided it has the requisite mass.

In the case of orchards one such sprinkler is needed for each tree, the sprinklers being attached to small diameter pipes which may be polyethylene.

The required pressure to operate the sprinkler is about 1.0 atmosphere depending upon the coverage diameter that it is required to irrigate.

The embodiment shown in FIG. 4 has the ball 2 replaced by a small cylindrical body 2' having chamfered ends. The purpose of the body 2' is to cause the water entering the sprinkler to spread uniformly in all directions on leaving the sprinkler. The body 2' is supported on a short tube 6 which is coaxial with the main body 1 and which is feeely rotatable therein. Water enters the inlet 4 under pressure, strikes the tube 6 tangentially and causes the body 2' supported thereby to rotate. In the embodiment of FIG. 5, the member 2' is supported by a ball 5 which is mounted within the body 1 so that it can rotate about a vertical axis. Again the ball 5 is so mounted that a jet of water from the inlet 4 rotates the ball 5 and member 2'.

FIGS. 6, 7 and 8 give details of the member in the interior of the embodiment shown in FIG. 4.

In both of the embodiments of FIGS. 4 to 5 the length of member 2' may be varied but should not be less than the diameter of outlet 3. The maximum length of member 2' may approach the internal diameter of body 1. The diameter of member 2' may vary between 0.5 to 2.0 the diameter of outlet 3.

The length of tube 6 may be approximately three quarters of the height of body 1.

Similarly the diameter of ball 5 may be varied and may, at a maximum approach the internal diameter of main body 1.

Both the tube 6 and ball 5 may be constructed from any suitable material and the performance of these two latter embodiments is similar to that of the embodiment of FIGS. 1 to 3.

An example of the relation between pressure and coverage diameter for a sprinkler with the above dimensions with a 16 mm inside body diameter and a 3 mm inlet diameter is as follows:

| Applied Pressure (atm) | Coverage diameter (m) |
|---|---|
| 0.2 | 2.0 |
| 0.3 | 3.0 |
| 0.5 | 4.0 |
| 1.0 | 5.0 |
| 2.0 | 6.0 |

The sprinkler described hereinbefore has a number of advantages.

(1) Cheap in construction (plastic).

(2) It operates with very low pressure.

(3) It has higher coverage diameter as compared to the existing sprayers working under similar conditions.

(4) It has a low application rate desirable for irrigating crops under unsaturated conditions.

(5) It has the flexibility to work with variable pressures from very low 0.2 atm up to 2 (even higher) thus permitting variable regulation of the desired coverage diameter.

(6) It could be used extensively in permanent installation in orchards due to the low cost and in small gardens where the use of regular sprinklers is not possible either due to small diameter required to be wetted or to the low pressure available.

(7) It does not need other accessories or fittings to be connected on the pipes as happens with other types of sprinklers thus making the whole installation much cheaper.

(8) It has the advantage that the water is spread in small drops which are not affected from wind as happens with some sprayers which require high pressure to operate and the outcoming water is in the form of mist which may be carried away from the wind.

What I claim is:

1. A sprinkler head comprising a body defining a generally cylindrical chamber, a liquid inlet to the chamber, and a liquid outlet from the chamber which is located on the central axis of the chamber and in use is located above the inlet, and further comprising a device disposed in the chamber so as to be freely rotatable therein about the central axis thereof, said device comprising a first member having a circular cross-section disposed with the central axis of said circular cross-section substantially parallel to the central axis of the chamber, and a cylindrical member mounted on the top of the first member, so as to be disposed between the first member and said liquid outlet, with its central axis extending substantially perpendicular to the central axis of said circular cross-section, and wherein the liquid inlet is arranged so that liquid entering the chamber by way of said liquid inlet strikes said first member tangentially to rotate it within said chamber.

2. A sprinkler head as claimed in claim 1, wherein said first member is a tube.

3. A sprinkler head as claimed in claim 2, wherein the length of the tube is substantially three quarters of the height of the chamber.

4. A sprinkler head as claimed in claim 1, wherein the first member is a ball.

5. A sprinkler head as claimed in claim 4, wherein the diameter of the ball is only slightly less than the diameter of the chamber.

6. A sprinkler head as claimed in claim 1, wherein the height of the chamber is approximately twice its diameter.

7. A sprinkler head as claimed in claim 6, wherein the diameters of the inlet and the outlet are each between a quarter and an eighth of the diameter of the chamber.

8. A sprinkler head as claimed in claim 1, wherein the length of the cylindrical member is only slightly less than the diameter of the chamber and the cylindrical member is chamfered at its ends, and the diameter of the cylindrical member is between substantially half the diameter of the outlet and substantially twice the diameter of the outlet.

* * * * *